US006382519B1

(12) United States Patent
Choi

(10) Patent No.: US 6,382,519 B1
(45) Date of Patent: May 7, 2002

(54) ASSEMBLING TYPE UNIT TRACK MEMBER FOR TOY VEHICLES

(76) Inventor: Bong Kyu Choi, 730 Choong-dong, Pucheon-shi, Kyongki-do 420-020 (KR)

( * ) Notice: Subject to any disclaimer, the term of this patent is extended or adjusted under 35 U.S.C. 154(b) by 0 days.

(21) Appl. No.: 09/576,876

(22) Filed: May 22, 2000

(51) Int. Cl.[7] ..... E01B 23/00
(52) U.S. Cl. ..... 238/10 R; 238/10 F
(58) Field of Search ..... 238/10 R, 10 A, 238/10 C, 10 E, 10 F

(56) References Cited

U.S. PATENT DOCUMENTS

| | | | | |
|---|---|---|---|---|
| 4,241,875 A | * | 12/1980 | Vandenbrink | 238/10 R |
| 4,941,610 A | * | 7/1990 | Frauca | 238/10 A |
| 5,160,091 A | * | 11/1992 | Hesse | 238/10 E |

FOREIGN PATENT DOCUMENTS

| | | |
|---|---|---|
| JP | SHO 61-196796 | 12/1986 |
| JP | SHO 62-74886 | 5/1987 |
| JP | HEI 2-28295 | 2/1990 |
| JP | HEI 2-79997 | 6/1990 |
| JP | HEI 3-63396 | 6/1991 |
| JP | HEI 3-73196 | 7/1991 |
| JP | HEI 5-44191 | 6/1993 |

* cited by examiner

*Primary Examiner*—Mark T. Le
(74) *Attorney, Agent, or Firm*—Donald C. Feix

(57) ABSTRACT

An assembling type unit track member for toy vehicles is disclosed, which can be assembled into an endless running track for toy vehicles. The assembling type unit track member for toy vehicles consists of a U shaped track member. The U shaped track member includes a bottom plate 1*a* and a protuberance 2 and a slot 2*a* formed at a center of the bottom plate 1*a,* for being assembled to other track members. A pair of trapezoidal coupling piece 3 and a pair of trapezoidal recesses 3*a* are formed on the bottom plate 1*a* and at both sides of the protuberance 2 and the slot 2*a*. A pair of pillar shaped walls 4 stand at both ends of the bottom plate 1*a,* and a projection 4*a* and a channel 4*b* are formed on each of the pillar shaped walls 4, for being coupled to other track members. The assembling type unit track member can be produced by a single die, and therefore, the production cost can be curtailed. Further, the bulk and length of the track member are very small, and therefore, all the track members can be contained in a small box, so that the transportation, handling and storing of them are convenient. Further, the contour of the track can be arbitrarily manipulated, and therefore children will enjoy pleasure for a long time.

1 Claim, 3 Drawing Sheets

ASSEMBLING TYPE UNIT TRACK MEMBER FOR TOY VEHICLES

BACKGROUND OF THE INVENTION

1. Field of the Invention

The present invention relates to an assembling type unit track member for toy vehicles, which can be assembled into an endless running track for toy vehicles.

2. Description of the Prior Art

In the conventional endless running track for toy vehicles, usually the assembled running track is elliptical, and consists of straight members and curved members. This running track members are detached to be stored and transported, but when using the endless running track, the straight and curved unit track members are assembled into an endless running track.

Since the conventional assembling type endless running track is manufactured by dividing it into straight members and curved members, the straight members are long, and the curved members have a large radius of curvature, with the result that the box for containing the straight and curved members has to be large. Consequently, the handling, transporting and storing are troublesome. Further, to produce the straight and curved members of the track, many of large dies are required, and therefore, the production cost becomes high. Further, if children breaks any one of the members of the track, then the whole track cannot be used, and therefore, has to be discarded.

SUMMARY OF THE INVENTION

The present invention is intended to overcome the above described disadvantages of the conventional technique.

Therefore it is an object of the present invention to provide an assembling type unit track member for toy vehicles, in which the disadvantages of the conventional technique are overcome.

In achieving the above object, the assembling type unit track member for toy vehicles according to the present invention consists of a U shaped track member. The U shaped track member includes: a bottom plate; a protuberance and a slot formed at a center of the bottom plate, for being assembled to other track members; a pair of trapezoidal coupling piece and a pair of trapezoidal recesses formed on the bottom plate and at both sides of the protuberance and the slot; a pair of pillar shaped walls upstanding at both ends of the bottom plate; and a projection and a channel formed on each of the pillar shaped walls, for being coupled to other track members.

The assembling type unit track member according to the present invention can be produced by a single die, and therefore, the production cost can be curtailed. Further, there occurs no deformation on the synthetic resin molded product. Further, the bulk and length of the track member are very small, and therefore, all the track members can be contained in a small box, so that the transportation, handling and storing of them are convenient. Further, even if several of the track members are lost or damaged, there is no problem assembling the endless track. Further, the track members are assembled on a plane, and according as the gaps between the track members are adjusted, straight portions and curved portions of the track can be arbitrarily formed.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
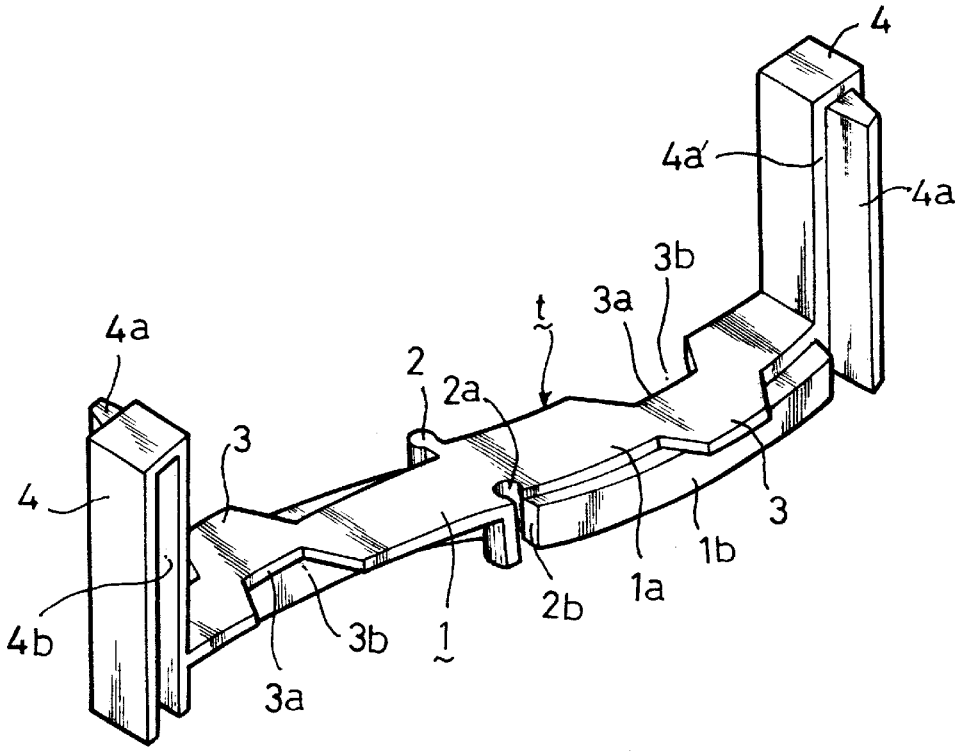
FIG. 1 is a perspective view of the assembling type unit track member according to the present invention.
Figure 2:
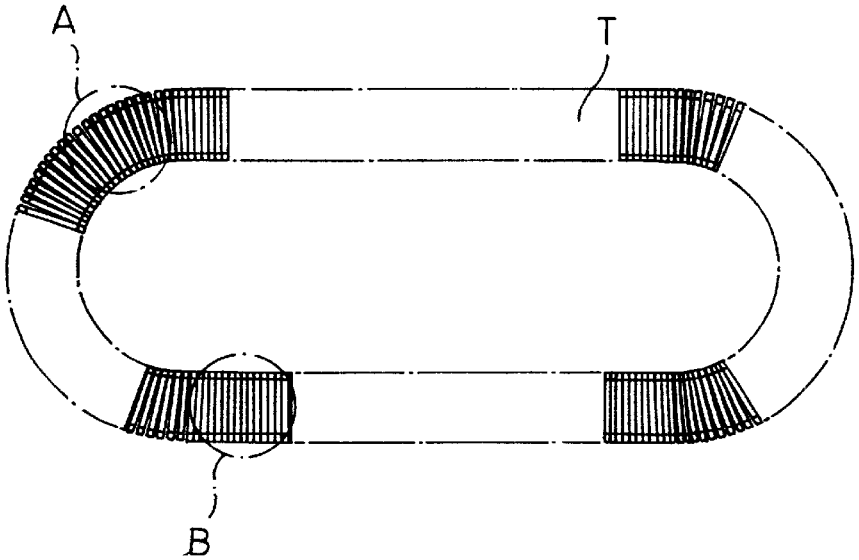
FIG. 2 is a plan view of an example of the assembled endless track for toys according to the present invention.

The assembling type track member consists of a U shaped track member 1. The track member 1 includes a bottom plate 1*a,* and a reinforcing rib 1*b* is laterally attached under the bottom plate 1*a,* so that the reinforcing rib 1*b* can serve as a treading portion and as a means for preventing the twisting of the track member 1.

A protuberance 2 and a coupling slot 2*a* are formed at the center of the bottom plate 1*a* and at the front and rear of the bottom plate 1*a* in a symmetric form. A mouth 2*b* of the slot 2*a* is elastic, and therefore, the track member can be coupled to other track members in a sure manner.

Further, a pair of trapezoidal coupling pieces 3 and a pair of recesses 3*a* are formed on the bottom plate 1*a* at both sides of the protuberance 2 and the slot 2*a* in a symmetric form. On the bottom of the recess 3*a,* there is formed a supporting pad 3*b.*

The track member 1 further includes a pair of pillar shaped walls 4 which includes a trapezoidal cross-sectioned projection 4*a* and a rectangular coupling channel 4*b* in a symmetric form, for being coupled to other track members. Thus a unit track member t is formed.

In the present invention, a plurality of the above described track members t are assembled as follows. That is, the protuberance 2, the coupling piece 3 and the projection 4*a* of the track member 1 are coupled to the coupling slot 2*a,* the recess 3*a* and the coupling channel 4*b* of another track member. This procedure is repeated until the whole track T is completed.

Under this condition, the protuberance 2 and the coupling slot 2*a* serves like the vertebrae in forming the assembled track T with the plurality of the unit track members.

If the assembled track is gently bent in the desired direction on the plane, the walls 4 of one side are densely coupled, while the walls 4 of the other side are spreadingly coupled, thereby forming the desired curve.

Under this condition, the coupling piece 3 and the projection 4*a* are of a trapezoidal shape, and therefore, they can be loosely moved within the trapezoidal recess 3*a* and in the rectangular coupling channel 4*b,* with the result that the assembling line of the track members can be easily curved.

Further, the protuberance 2 and the coupling slots 2*a* can be coupled together in the vertical direction, but cannot be detached in the horizontal direction, and therefore, they serve as the supporting shaft of the track T. Further, the coupling slot 2*a* is elastic, and therefore, the supporting strength is further reinforced.

Further, an assembled straight track portion can be changed to a curved track portion. That is, the unit track members can be horizontally turned by being supported by the protuberance 2 and the coupling slots 2*a*. The projection 4*a* of the wall 4 can enter and withdraw to and from the coupling channel 4*b,* and the coupling piece 3 of the bottom plate 1*a* is movable on the horizontal plane. Accordingly, the assembled straight track portion can be changed to a curved track portion, and vice versa.

Figure 3:
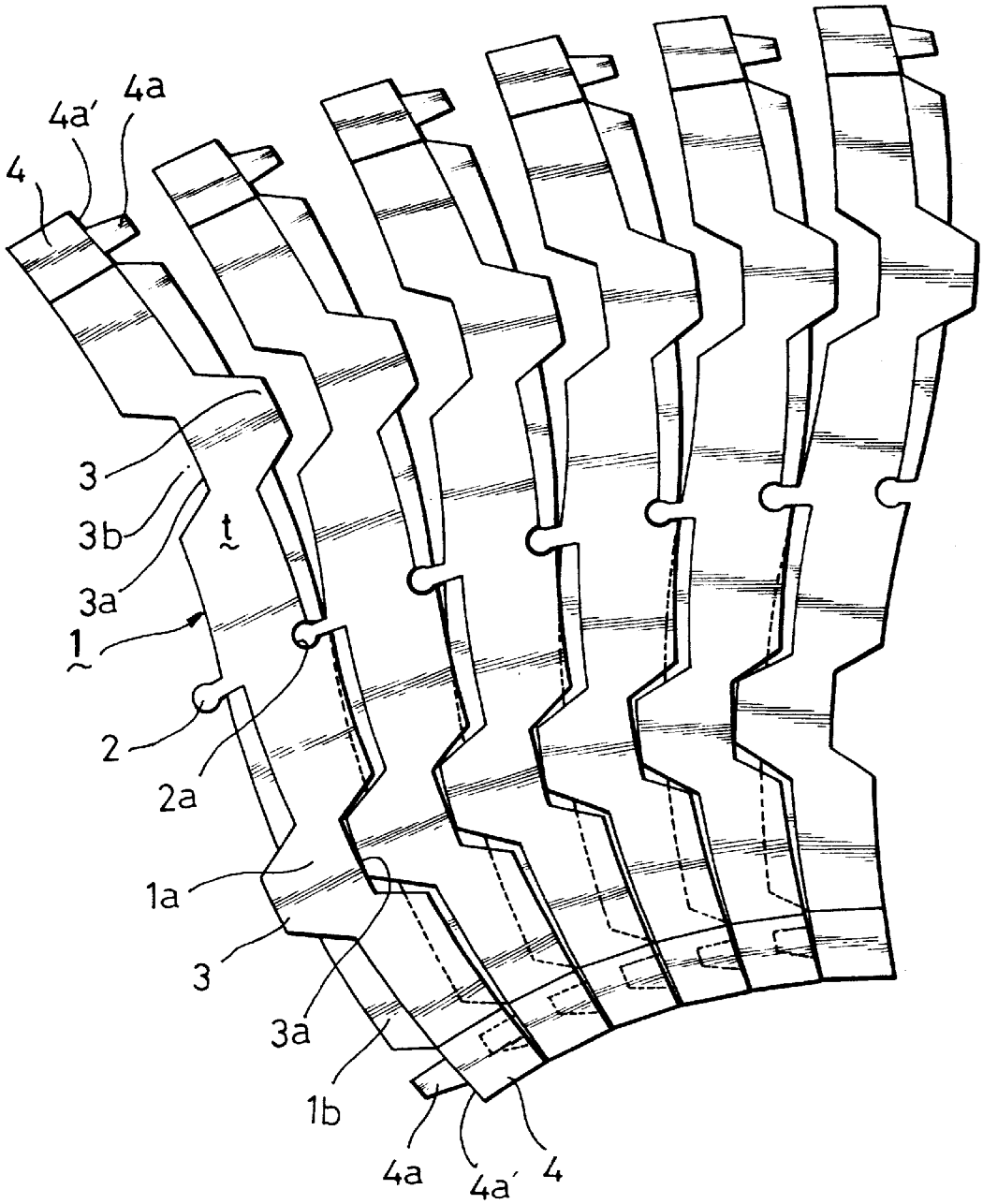
FIG. 3 is an enlarged view of the portion A (curved portion) of FIG. 2.
Figure 4:
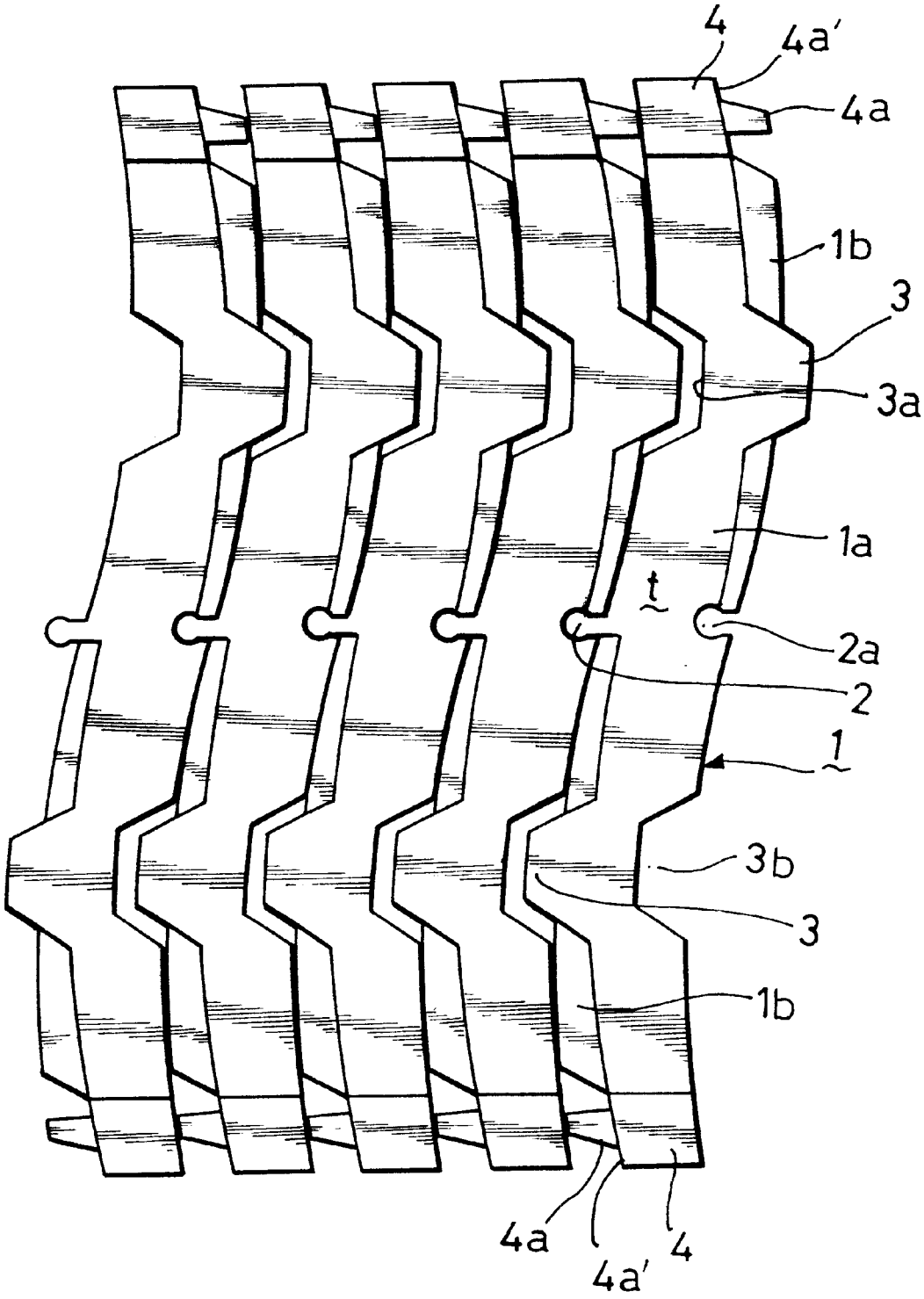
FIG. 4 is an enlarged view of the portion B (straight portion) of FIG. 2.

By properly combining the curved track portion A of FIG. 3 and the straight track portion B of FIG. 4, an S shaped track or an o shaped track can be arbitrarily formed.

If tired with the existing contour, then the shape of the track can be altered.

Further, the pair of the pillar shaped walls 4 serve as the guard rail or protecting walls, and thus, when an automobile runs along the track, the walls 4 prevent the automobile from being strayed.

Accordingly, a child or children can enjoy the playing with a remote controlled automobile or a dry cell using automobile.

After the use of the track, if the track needs be taken away from the place, then the track members are detached and stored in a small box.

According to the present invention as described above, a plurality of the U shaped unit track members are assembled into a desired contour of the track. Further, when producing the unit track members, only a single molding die is used, and therefore, the production cost is lowered. Further, the bulk and length of the track member are very small, and therefore, all the track members can be contained in a small box, so that the transportation, handling and storing of them are convenient. Further, even if several of the track members are lost or damaged, there is no problem in assembling the endless track. Further, the track members are assembled on a plane, and according as the gaps between the track members are adjusted, straight portions and curved portions of the track can be arbitrarily manipulated. Owing to the diversified contours of the track, children will enjoy a sustained pleasure.

What is claimed is:

1. An unit track for assembly with other unit track members to form a track portion and comprising:

a bottom plate;

a single protuberance and a single coupling slot formed at a center of said bottom plate, for being assembled to other track members;

said protuberance being constructed for rotational movement within a coupling slot of an associated track member, a pair of trapezoidal coupling pieces and a pair of trapezoidal recesses formed on said bottom plate and at both sides of said protuberance and said coupling slot;

a pair of pillar shaped walls upstanding at both ends of said bottom plate;

a trapezoidal projection and a trapezoidal coupling channel formed on each of said pillar shaped walls in a symmetric form, for being coupled to other track members; and said trapezoidal coupling pieces and trapezoidal recesses and said trapezoidal projections and trapezoidal coupling channels being configured to permit a trapezoidal coupling piece of a first track member to be loosely moved within the trapezoidal recess of a second, associated track member and to permit a trapezoidal projection on a pillar shaped wall of the first track member to be loosely moved into and out of a trapezoidal coupling channel of a pillar shaped wall of the second, associated track member while the first and second track members are maintained coupled together by the protuberance of the first track member within the coupling slot of the second track member so that a straight track portion assembled from said track members can be changed to a curved track portion and vice versa.

* * * * *